US010864144B1

(12) United States Patent
Skaggs

(10) Patent No.: US 10,864,144 B1
(45) Date of Patent: Dec. 15, 2020

(54) BABY BOTTLE ASSEMBLY

(71) Applicant: David B. Skaggs, St. Louis, MO (US)

(72) Inventor: David B. Skaggs, St. Louis, MO (US)

( * ) Notice: Subject to any disclaimer, the term of this patent is extended or adjusted under 35 U.S.C. 154(b) by 252 days.

(21) Appl. No.: 16/190,214

(22) Filed: Nov. 14, 2018

Related U.S. Application Data

(60) Provisional application No. 62/586,619, filed on Nov. 15, 2017.

(51) Int. Cl.
*A61J 9/04* (2006.01)
*A61J 9/08* (2006.01)
*A61J 11/04* (2006.01)

(52) U.S. Cl.
CPC ..... *A61J 9/04* (2013.01); *A61J 9/08* (2013.01); *A61J 11/04* (2013.01)

(58) Field of Classification Search
CPC .... A61J 9/04; A61J 9/003; A61J 9/001; A61J 9/08; A61J 11/04
USPC ..... 215/11.5
See application file for complete search history.

(56) References Cited

U.S. PATENT DOCUMENTS 4,685,577 A * 8/1987 Chen ..... A61J 11/001 215/11.4
4,723,668 A * 2/1988 Cheng ..... A61J 9/04 215/11.5
4,730,744 A * 3/1988 Vinciguerra ..... A61J 9/04 215/11.1
4,821,896 A * 4/1989 Cheng ..... A61J 9/001 215/11.3
5,431,290 A * 7/1995 Vinciguerra ..... A61J 9/04 137/845
5,456,090 A 10/1995 McCoy
5,499,729 A 3/1996 Greenwood
5,570,796 A 11/1996 Brown
5,692,627 A 12/1997 Feng
5,699,921 A * 12/1997 Rodriguez ..... A61J 9/04 215/11.5
6,053,342 A 4/2000 Chomik
6,209,736 B1 * 4/2001 Chen ..... A61J 9/04 215/11.1
6,446,822 B1 9/2002 Meyers
6,601,720 B2 8/2003 Meyers
6,880,713 B2 4/2005 Holley
(Continued)

*Primary Examiner* — Ernesto A Grano
(74) *Attorney, Agent, or Firm* — Linda L. Lewis

(57) ABSTRACT

A baby bottle assembly for bottom venting includes a bottle having a top closure member adapted for releasable engagement with a top portion of the bottle, and a bottom closure member adapted for releasable engagement with a base portion of the bottle. The bottom closure member has a base panel with a raised portion having an air passage therethrough and a top sealing surface. A diaphragm is positionable between the bottom closure member and the base portion. The diaphragm has a disc, at least one moveable sealing element for sealingly engaging the top sealing surface, and an air passage extending under the at least one moveable sealing element into the liquid chamber. The diaphragm is moveable between a sealed position and an unsealed position. The moveable sealing element when in the sealed position prevents liquid contained within a liquid chamber of the bottle from entering the air passage. When in the unsealed position, the diaphragm allows bottom venting of the bottle.

12 Claims, 7 Drawing Sheets

(56) References Cited

U.S. PATENT DOCUMENTS

| | | | | |
|---|---|---|---|---|
| 8,016,142 | B2 * | 9/2011 | Renz | A61J 9/04 215/11.5 |
| 8,567,619 | B2 | 10/2013 | Renz | |
| 8,640,902 | B2 | 2/2014 | Tirosch | |
| 8,727,147 | B2 | 5/2014 | Kemper | |
| 2003/0183596 | A1 * | 10/2003 | Lombardo | A61J 9/04 215/11.5 |
| 2004/0178163 | A1 | 9/2004 | Kerns | |
| 2007/0045215 | A1 | 3/2007 | Holley | |
| 2007/0075029 | A1 * | 4/2007 | Yates | A61J 9/04 215/11.5 |
| 2007/0262041 | A1 | 11/2007 | Smith | |
| 2009/0039047 | A1 * | 2/2009 | Shtalryd | A61J 9/04 215/11.5 |
| 2010/0038336 | A1 * | 2/2010 | Kheradvar | A61J 9/04 215/11.5 |
| 2010/0308003 | A1 * | 12/2010 | Morrill | A61J 11/0085 215/11.4 |
| 2013/0140260 | A1 * | 6/2013 | Dunn | A61J 11/006 215/11.4 |
| 2013/0277327 | A1 * | 10/2013 | Fong | A61J 9/08 215/11.5 |
| 2015/0231035 | A1 * | 8/2015 | Berkovitch | A61J 9/04 215/11.5 |
| 2015/0290086 | A1 * | 10/2015 | Prentice | A61J 11/045 215/11.5 |
| 2016/0067146 | A1 * | 3/2016 | Zhou | A61J 9/04 215/11.5 |
| 2018/0214349 | A1 * | 8/2018 | Mayer | A61J 11/0085 |
| 2018/0296443 | A1 * | 10/2018 | Roehrig | A61J 11/04 |

* cited by examiner

BABY BOTTLE ASSEMBLY

CROSS-REFERENCE TO RELATED APPLICATIONS

This application claims the benefit of provisional patent application, Ser. No. 62/586,619, filed on Nov. 15, 2017.

STATEMENT REGARDING FEDERALLY SPONSORED RESEARCH

Not Applicable.

APPENDIX

Not Applicable.

BACKGROUND OF THE INVENTION

Field of the Invention

The present invention relates to a bottom venting baby bottle assembly, and more particularly to a diaphragm for a bottom venting baby bottle assembly having a central air passage that is covered and separated from the liquid chamber of the baby bottle when in the sealed position.

Related Art

The prior art device disclosed in U.S. Pat. No. 8,727,147, which is hereby incorporated by reference, has been used as a baby bottle with bottom venting of air into the liquid chamber when the baby is sucking and creating a negative pressure, to prevent ingestion of air by feeding infants. When there is a positive pressure, e.g., liquid in the liquid chamber and no sucking, the bottom vent is sealed so that liquid does not leak out of the bottom of the bottle. As shown in FIG. 1, the diaphragm of the '147 patent has a central air passage 95 which channels air from air holes 79 through the central air passage 95 into the bottle cavity when there is a negative pressure in the bottle chamber 28. There must be enough negative pressure for the diaphragm 83 to flex upward, creating air flow through the air holes and the central air passage. The central air passage 95 is open and uncovered when there is liquid and a positive pressure in the bottle. The air passage 95 is narrow and easily blocked. Dried milk can plug the passage and prove difficult to clean. The present invention does not have a central air passage that is open and uncovered when there is a positive pressure in the bottle. Likewise, it is easy to clean and maintain.

Examples of known prior art devices are described in the references listed below, and are hereby incorporated by reference. U.S. Pat. Nos. 6,446,822 and 6,601,720 disclose a bottom-venting baby bottle with a one-way venting valve that flexes to an open position when there is a negative pressure in the bottle. The one-way vent is complicated and subject to leaking when there is a positive pressure. US patent application US2007/0045215 discloses a bottom venting baby bottle that uses pin holes as one-way valves to allow air in when there is a negative pressure. These pin holes are easily plugged and may leak when there is positive pressure.

SUMMARY OF THE INVENTION

The present invention is a baby bottle assembly having a bottom vent. The assembly has a bottle defining a liquid chamber for holding a quantity of liquid having an open bottom, an open top, and a sidewall extending between the open bottom and the open top. The sidewall has a top portion, a base portion, and middle portion extending between the top and base portions. A top closure member is adapted for releasable engagement with the top portion of the bottle for closing the open top of the bottle. A bottom closure member is adapted for releasable engagement with the base portion of the bottle for closing the open bottom of the bottle. The bottom closure member has a raised portion with at least one center air passage therethrough. The raised portion has a top sealing surface. A diaphragm is positioned between the bottom closure member and the base portion of the bottle. The diaphragm has a sealed position when there is positive pressure in the liquid chamber and an unsealed position when there is a negative pressure in the liquid chamber. In the sealed position, no liquid in the liquid chamber leaks through the bottom closure member. The diaphragm has at least one diaphragm air passage and at least one moveable sealing element for sealingly engaging the top sealing surface of the bottom closure member to close the at least one diaphragm air passage in the sealed position, and also seal the central air passage from the liquid chamber. When pressure in the liquid chamber is negative, and the diaphragm is in the unsealed position, air flows through the central air passage and the diaphragm air passage into the liquid chamber.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
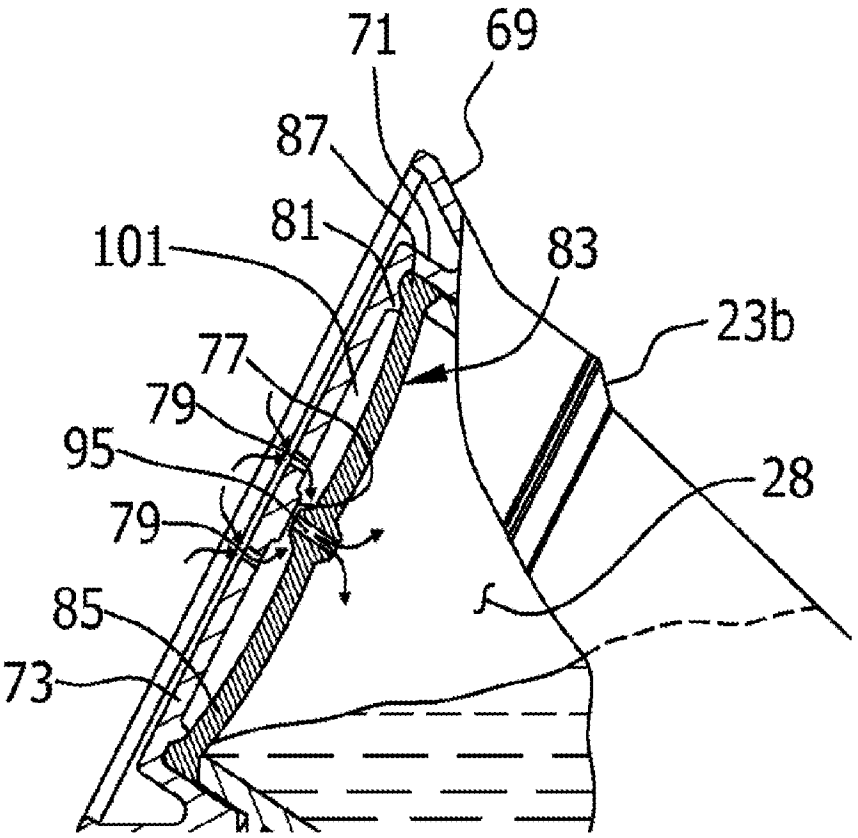
Figure 1 Prior Art
FIG. 1 is a vertical cross section of a prior art bottle assembly showing the diaphragm in the unsealed position.

A prior art bottle assembly is shown in FIG. 1. The central air passage 95 is open to the liquid chamber 28, in both the sealed and unsealed positions.

Figure 2:
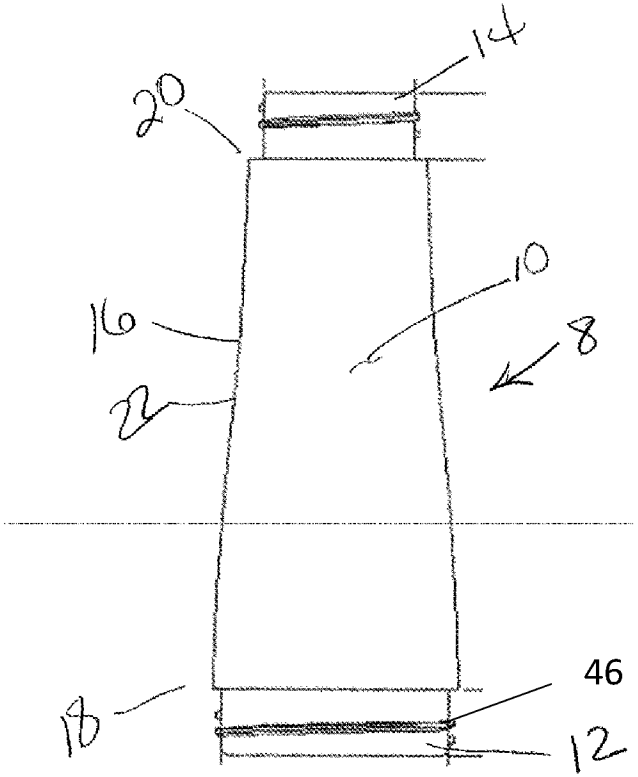
FIG. 2 is a side perspective of the bottle of the bottle assembly of an embodiment.

The present invention is a bottle assembly having a bottom vent. As shown in FIG. 2, the present assembly has a bottle 8 defining a liquid chamber 10 for holding a quantity of liquid having an open bottom 12, an open top 14, and a sidewall 16 extending between the open bottom and the open top. The sidewall has a top portion 20, a base portion 18, and middle portion 22 extending between the top and base portions.

Figure 2A:
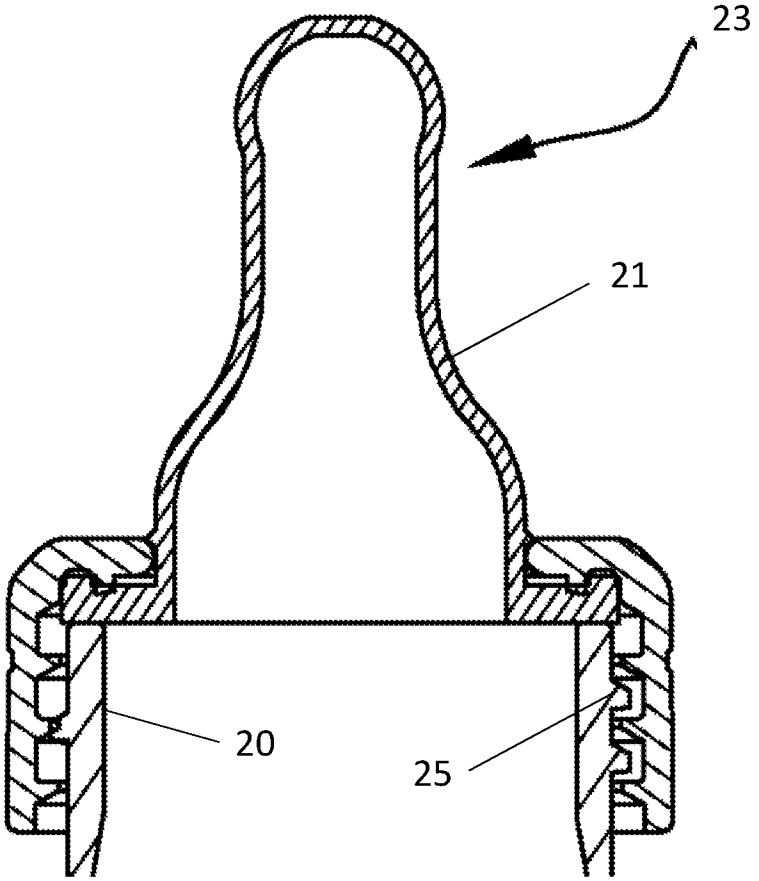
FIG. 2A is a vertical cross section of the top closure of the bottle assembly.

As shown in FIG. 2A, an embodiment of a top closure 23 is adapted for releasable engagement with the top portion of the bottle for closing the open top of the bottle. The top closure member has a nipple 21 held in place by a treaded rim 25. The nipple allows liquid held in the liquid chamber to exit the bottle assembly when sucked by a baby.

Figure 3:
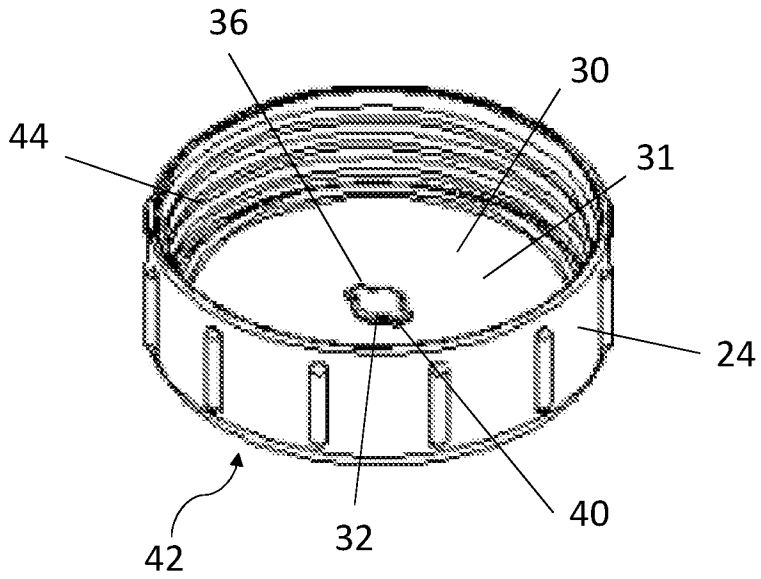
FIG. 3 is a raised side perspective of the bottom closure of the bottle assembly with the diaphragm inserted in it.
Figure 4:
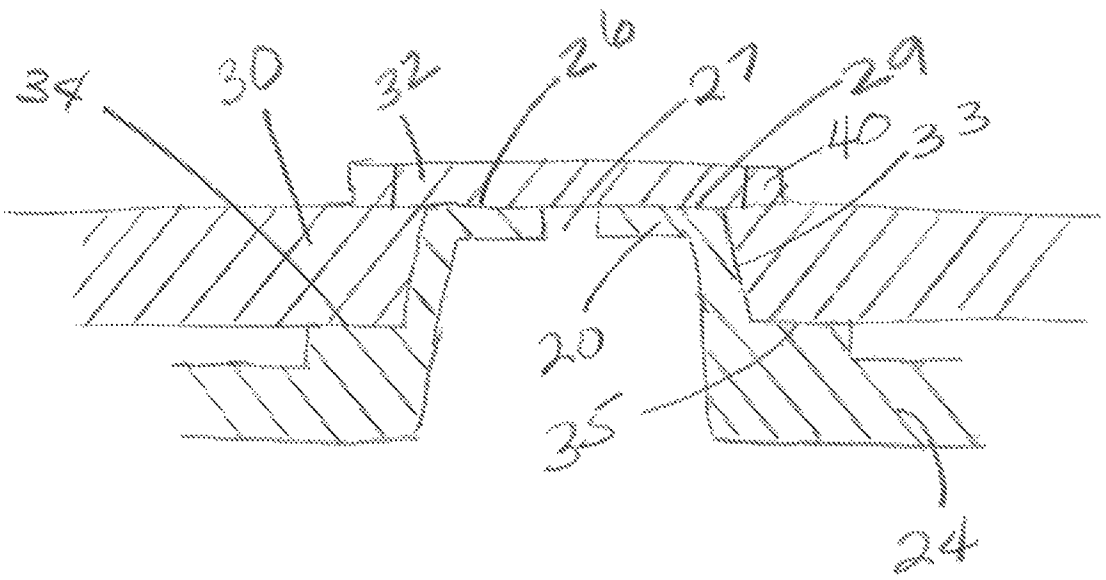
FIG. 4 is a vertical cross section of the diaphragm inserted into the bottom closure of the bottle assembly.

As shown in FIGS. 3 and 4, a bottom closure 24 is adapted for releasable engagement with the base portion of the bottle for closing the open bottom of the bottle. Preferably, the bottom closure has a bottom closure flat portion 42 and an annular threaded portion 44 and engages with the base portion threads 46. The bottom closure member has a raised portion 26. The raised portion 26 has a top sealing surface 29, a center annular sealing surface 35 surrounding the raised portion, and a central air passage 27, all axially aligned with the raised portion. In a preferred embodiment, the raised portion 26 is placed in the center of a circular base portion.

Figure 5:
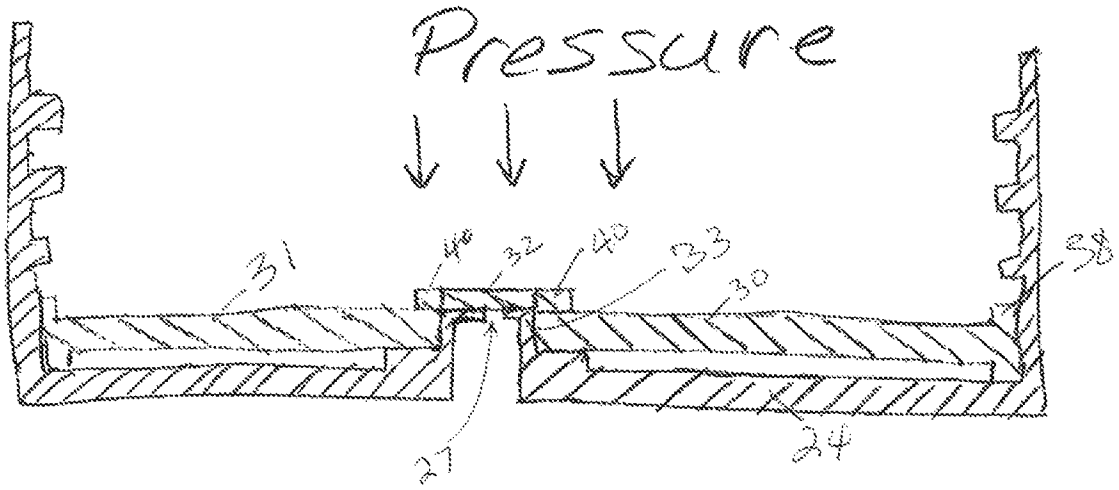
FIG. 5 is a vertical cross section of the diaphragm inserted into the bottom closure in the sealed position.
Figure 6:
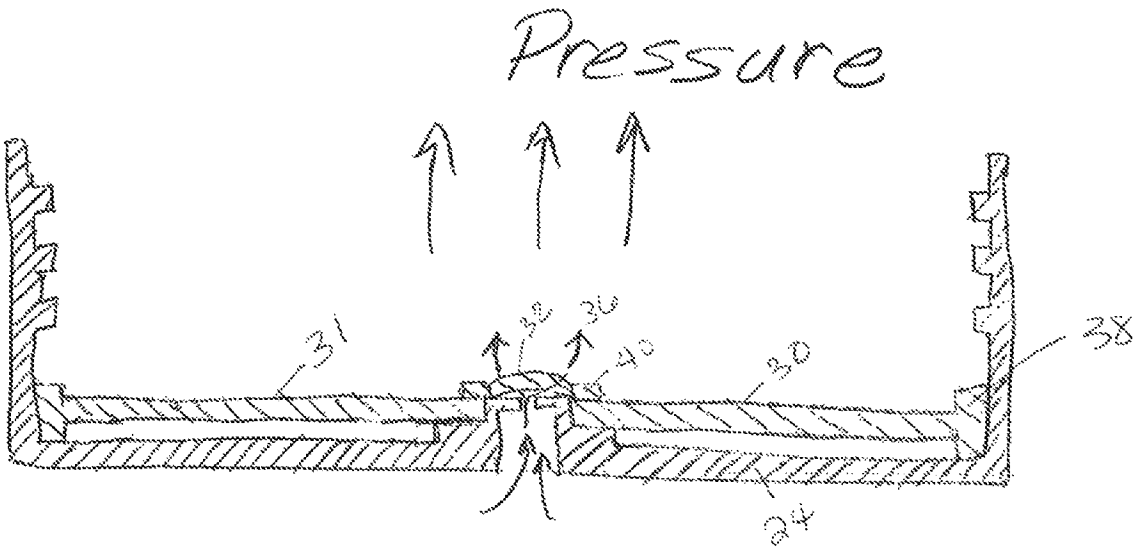
FIG. 6 is a vertical cross section of the diaphragm inserted into the bottom closure in the unsealed position.

A diaphragm 30 is positionable between the bottom closure member and the base portion of the bottle. As shown in FIGS. 3, 5 and 6, the diaphragm 30 has a disc portion 31. The disc portion 31 is essentially flat and liquid impermeable. Optionally, the diaphragm may have an annular rim 38 to provide a liquid-tight seal when engaged with the base portion 18 of the liquid chamber and the bottom closure 24. The diaphragm is made of liquid impermeable flexible polymeric food-grade material or of liquid impermeable inflexible food-grade material, as the disc portion 31 does not have to flex for the diaphragm to vent. The diaphragm 30 has a disc portion 31, a moveable sealing element 32 positioned above the raised portion opening 33 and diaphragm attachment points 40, which attach the moveable sealing element 32 to the disc portion 31.

The moveable sealing element 32 does flex and is made of a liquid impermeable flexible food grade polymeric substance. The moveable sealing element 32 is essentially flat and positioned over the raised portion when assembled in the bottle assembly. It is large enough to cover and seal the central air passage when in the sealed position. The moveable sealing element seals against the top sealing surface 29, and is attached to the disc portion 31 of the diaphragm by at least two diaphragm attachment points 40. In a preferred embodiment, the moveable sealing element 32 is flat with a circular perimeter, and with attachment points 40 being on opposite sides of the perimeter. The remaining portion of the circular perimeter is unattached and moveable. The raised portion opening of the diaphragm is an opening sized to engage with the raised portion 26 of the bottom closure, and is shaped so that the raised portion nests within the raised portion opening. The diaphragm air passage 36 is created when the bottle assembly is in the unsealed position and the moveable sealing element raises from the top sealing surface 29 and raised portion opening 33 creating the air passage. Typically, the diaphragm air passage 36 is created as the negative pressure in the liquid chamber causes the moveable seating element to bow inward toward the liquid chamber. The bowed element allows the Air to flow through the central air passage 27 through the diaphragm air passage 36 into the liquid chamber 10.

As shown in FIG. 4, the diaphragm also has a diaphragm annular sealing surface 34 on the bottom side of the diaphragm for engaging with the center annular sealing surface 35 of the bottom closure member.

In a preferred embodiment, the raised portion is axially aligned with all of the following: the raised portion opening, the central air passage, the diaphragm annular sealing surface, the bottom closure annular sealing surface, and the moveable sealing element.

As shown in FIG. 4, the assembly of the present invention has a diaphragm wherein the central air passage 27 is covered by the moveable sealing element 32 when the diaphragm is in the sealed position. In the sealed position, the central air passage 27 is separated from the liquid chamber 10 by the moveable sealing element 32.

As shown in FIG. 6, diaphragm air passage 36 extends under the at least one moveable sealing element when it is in the unsealed position.

When liquid is held in the liquid chamber creating a positive pressure, the diaphragm is exposed to the liquid, but has no air passages open that can become plugged with milk or formula. The diaphragm is designed to move to a sealed position wherein the at least one sealing element is sealingly engaged with top sealing surface of the raised portion of the bottom closure member, thereby sealing the central air passage. No liquid leaks out of the bottom closure member from the liquid chamber when it is in the sealed position. When the pressure is negative, the diaphragm can move to an unsealed position wherein the moveable sealing element is at least partially disengaged from the raised portion of the bottom closure member to allow air to pass through the air passage under the diaphragm and into the liquid chamber of the bottle.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

The invention claimed is:

1. A baby bottle assembly comprising a bottle defining a liquid chamber for holding a quantity of liquid having an open bottom portion, an open top portion, and a sidewall extending between the open bottom and the open top portions;

wherein the sidewall has a top portion, a base portion, and middle portion extending between the top and base portions;

a top closure member adapted for releasable engagement with the top portion of the bottle for closing the open top of the bottle;

a bottom closure member adapted for releasable engagement with the base portion of the bottle for closing the open bottom of the bottle; wherein the bottom closure member has a raised portion, a top center annular sealing surface encircling the raised portion, a top sealing surface and at least one center air passage through the raised portion;

a diaphragm positionable between the bottom closure member and the base portion of the bottle;

wherein the diaphragm has a sealed position when there is positive pressure in the liquid chamber and an unsealed position when there is a negative pressure in the liquid chamber;

wherein the diaphragm has a disc portion that is liquid impenetrable;

wherein positioned on the disc portion and above the raised portion is a moveable sealing surface;

wherein the on the bottom of the disc portion is a diaphragm annular sealing surface that sealingly engages with the center annular sealing surface;

wherein, in the sealed position, the at least one moveable sealing element seals the top sealing surface, thereby sealing the central air passage;

wherein in the sealed position, the diaphragm air passageway and the central air passageway are sealed from the liquid chamber by the moveable sealing element;

wherein in the sealed position, no liquid from the liquid chamber leaks from the bottom closure; and wherein in the unsealed position, the diaphragm air passageway proximate the moveable sealing element opens, and allows air to enter the liquid chamber.

2. The baby bottle assembly of claim 1, wherein the disc portion is essentially flat.

3. The baby bottle assembly of claim 2, wherein the diaphragm has an annular rim.

4. The baby bottle assembly of claim 3, wherein the diaphragm has a raised portion opening sized to nest with the bottom closure raised portion.

5. The baby bottle assembly of claim 4, wherein the moveable sealing element is essentially flat and has at least two attachment points.

6. The baby bottle assembly of claim 5, wherein in the unsealed position, the moveable sealing element bows in toward the liquid chamber.

7. The baby bottle assembly of claim 6, wherein the moveable sealing element has a circular perimeter, and with attachment points being on opposite sides of the perimeter.

8. The baby bottle assembly of claim 7, wherein portion of the circular perimeter without attachment points is unattached and moveable.

9. A baby bottle assembly comprising a bottle defining a liquid chamber for holding a quantity of liquid having an open bottom portion, an open top portion, and a sidewall extending between the open bottom and the open top portions;

wherein the sidewall has a top portion, a base portion, and middle portion extending between the top and base portions;

a top closure member adapted for releasable engagement with the top portion of the bottle for closing the open top of the bottle;

a bottom closure member adapted for releasable engagement with the base portion of the bottle for closing the open bottom of the bottle; wherein the bottom closure member has a raised portion, a top center annular sealing surface encircling the raised portion, a top sealing surface and at least one center air passage through the raised portion;

a diaphragm positionable between the bottom closure member and the base portion of the bottle;

wherein the diaphragm has a sealed position when there is positive pressure in the liquid chamber and an unsealed position when there is a negative pressure in the liquid chamber;

wherein the diaphragm has a disc portion that is liquid impenetrable;

wherein positioned on the disc portion and above the raised portion is a moveable sealing surface;

wherein the moveable sealing element is flat with a circular perimeter;

wherein the moveable sealing element has attachment points to the disc portion on opposite sides of the circular perimeter;

wherein portion of the circular perimeter without attachment points is unattached and moveable;

wherein the on the bottom of the disc portion is a diaphragm annular sealing surface that sealingly engages with the center annular sealing surface;

wherein, in the sealed position, the at least one moveable sealing element seals the top sealing surface, thereby sealing the central air passage;

wherein in the sealed position, the diaphragm air passageway and the central air passageway are sealed from the liquid chamber by the moveable sealing element;

wherein in the sealed position, no liquid from the liquid chamber leaks from the bottom closure; and wherein in the unsealed position, the diaphragm air passageway proximate the moveable sealing element opens, and allows air to enter the liquid chamber.

10. The baby bottle assembly of claim 9, wherein the bottom closure member, the raised portion, the top sealing surface, the center annular sealing surface, and the central air passage, are all axially aligned.

11. The baby bottle assembly of claim 9, wherein the raised portion opening, the central air passage, the diaphragm annular sealing surface, the bottom closure annular sealing surface, and the moveable sealing element are all axially aligned.

12. The baby bottle assembly of claim 9, wherein the moveable sealing element is liquid impermeable.

* * * * *